US012012875B2

(12) United States Patent
Ozeki

(10) Patent No.: US 12,012,875 B2
(45) Date of Patent: Jun. 18, 2024

(54) VARIABLE VALVE DEVICE

(71) Applicant: SUZUKI MOTOR CORPORATION, Hamamatsu (JP)

(72) Inventor: Hisashi Ozeki, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 18/193,181

(22) Filed: Mar. 30, 2023

(65) Prior Publication Data

US 2023/0323798 A1 Oct. 12, 2023

(30) Foreign Application Priority Data

Apr. 6, 2022 (JP) ..... 2022-063378

(51) Int. Cl.
*F01L 1/344* (2006.01)

(52) U.S. Cl.
CPC ..... *F01L 1/344* (2013.01)

(58) Field of Classification Search
CPC ... F01L 1/344; F01L 2013/0052; F01L 1/047; F01L 2001/0473; F01L 1/053; F01L 2001/0535; F01L 1/181; F01L 13/0047; F01L 1/26
USPC ..... 123/90.16
See application file for complete search history.

(56) References Cited

U.S. PATENT DOCUMENTS 4,656,977 A * 4/1987 Nagahiro ..... F01L 13/0063 123/90.16
4,926,804 A * 5/1990 Fukuo ..... F01L 1/267 123/90.16
4,960,094 A * 10/1990 Koike ..... F02D 13/0203 123/406.13
4,960,095 A * 10/1990 Koike ..... F02P 5/152 123/406.35
6,530,351 B2 * 3/2003 Mikame ..... F01L 1/3442 123/90.15
6,953,012 B2 * 10/2005 Hirano ..... F01L 1/30 123/90.15
7,699,030 B2 * 4/2010 Nomura ..... F01L 1/053 123/90.15
2001/0054403 A1 * 12/2001 Fujii ..... F01L 13/0036 123/90.15

(Continued)

FOREIGN PATENT DOCUMENTS

DE 102013225965 A1 7/2014
DE 102021107158 A1 9/2021

(Continued)

OTHER PUBLICATIONS

Extended European Search Report issued to European Application No. 23165193.6 on Oct. 18, 2023.

*Primary Examiner* — J. Todd Newton
(74) *Attorney, Agent, or Firm* — Stein IP, LLC

(57) ABSTRACT

There is provided a variable valve device provided in a cylinder head and capable of changing a valve lift amount, including: a camshaft on which a plurality of cams with different valve lift amounts are formed; a switching mechanism configured to switch a cam for moving a valve among the plurality of cams; and an oil control valve configured to control an oil pressure for the switching mechanism. Oil starts to be supplied from the oil control valve to the switching mechanism at an end timing of a valve lift or in a zero range in which no valve lift occurs.

9 Claims, 10 Drawing Sheets

(56) References Cited

U.S. PATENT DOCUMENTS

| | | | | |
|---|---|---|---|---|
| 2012/0222635 | A1* | 9/2012 | Sunada | F01L 1/185<br>123/90.15 |
| 2016/0363011 | A1* | 12/2016 | Choi | F01L 13/0005 |
| 2022/0412233 | A1* | 12/2022 | Ozeki | F01L 1/181 |

FOREIGN PATENT DOCUMENTS

| | | | |
|---|---|---|---|
| EP | 2487341 | A1 | 8/2012 |
| JP | 2009-264199 | A | 11/2009 |
| WO | WO 2015/141720 | A1 | 9/2015 |

* cited by examiner

VARIABLE VALVE DEVICE

CROSS-REFERENCE TO RELATED APPLICATIONS

This application is based on Japanese Patent Application No. 2022-063378 filed on Apr. 6, 2022, the contents of which are incorporated herein by way of reference.

TECHNICAL FIELD

The present invention relates to a variable valve device.

BACKGROUND

In the related art, there is a variable valve device in which a valve lift amount is changed according to an engine rotation speed (see, for example, Patent Literature 1). In the variable valve device disclosed in Patent Literature 1, a valve is moved via a rocker arm as a camshaft rotates. A pair of cams with different lift amounts are formed on the camshaft, and a pair of the rocker arms are provided corresponding to the pair of cams. By switching a coupling state of the pair of rocker arms by a switching mechanism of the variable valve device, a cam that lifts the valve is switched to change the valve lift amount.

Patent Literature 1: JP2009-264199A

In such a variable valve device, switching operation of the cam is performed by the switching mechanism regardless of a phase of the camshaft. In a case where the switching operation of the cam is performed during a valve lift, abnormal noise may be generated due to malfunction of the switching operation, which may reduce the durability of the variable valve device. A similar malfunction occurs not only in the switching operation of the cam using the rocker arm, but also in the switching operation of the cam using a shift cam.

The present invention is made in view of the above circumstances, and an object of the present invention is to provided a variable valve device which can be improved in durability while reducing abnormal noise when a valve lift amount is changed.

SUMMARY

There is provided a variable valve device provided in a cylinder head and capable of changing a valve lift amount, including: a camshaft on which a plurality of cams with different valve lift amounts are formed; a switching mechanism configured to switch a cam for moving a valve among the plurality of cams; and an oil control valve configured to control an oil pressure for the switching mechanism. Oil starts to be supplied from the oil control valve to the switching mechanism at an end timing of a valve lift or in a zero range in which no valve lift occurs.

DESCRIPTION OF EMBODIMENTS

A variable valve device according to an aspect of the present invention is provided in a cylinder head, and changes a valve lift amount. A plurality of cams with different valve lift amounts are formed on a camshaft, and a cam for moving the valve is switched among the plurality of cams by a switching mechanism. An oil pressure for the switching mechanism is controlled by an oil control valve, and oil starts to be supplied from the oil control valve to the switching mechanism at an end timing of a valve lift or in a zero range in which no valve lift occurs. Therefore, the switching operation of the cam is not hindered by the valve lift. Therefore, occurrence of abnormal noise caused by a malfunction in the switching operation of the cam is suppressed, and the durability of the variable valve device is improved.

EMBODIMENT

First Embodiment

Figure 1:
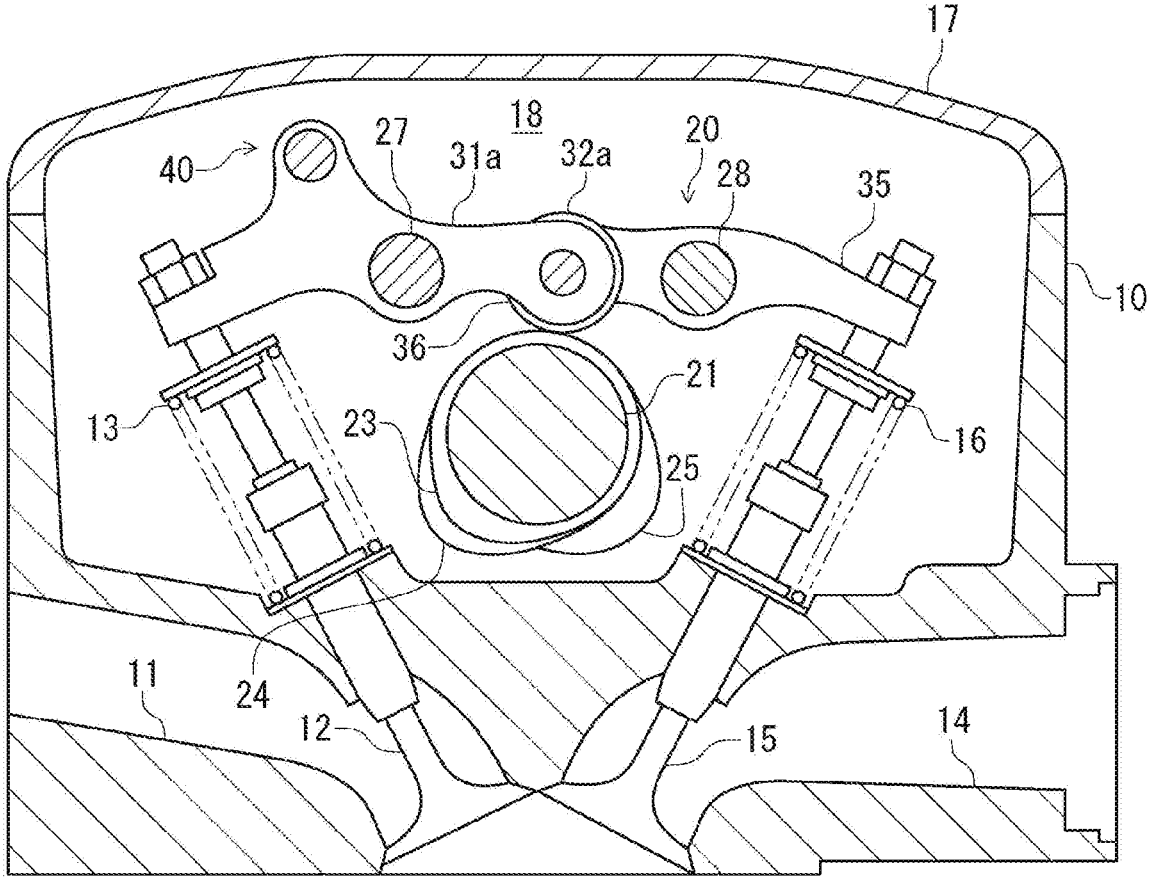
FIG. 1 is a schematic cross-sectional view of a variable valve device according to a first embodiment.
Figure 2:
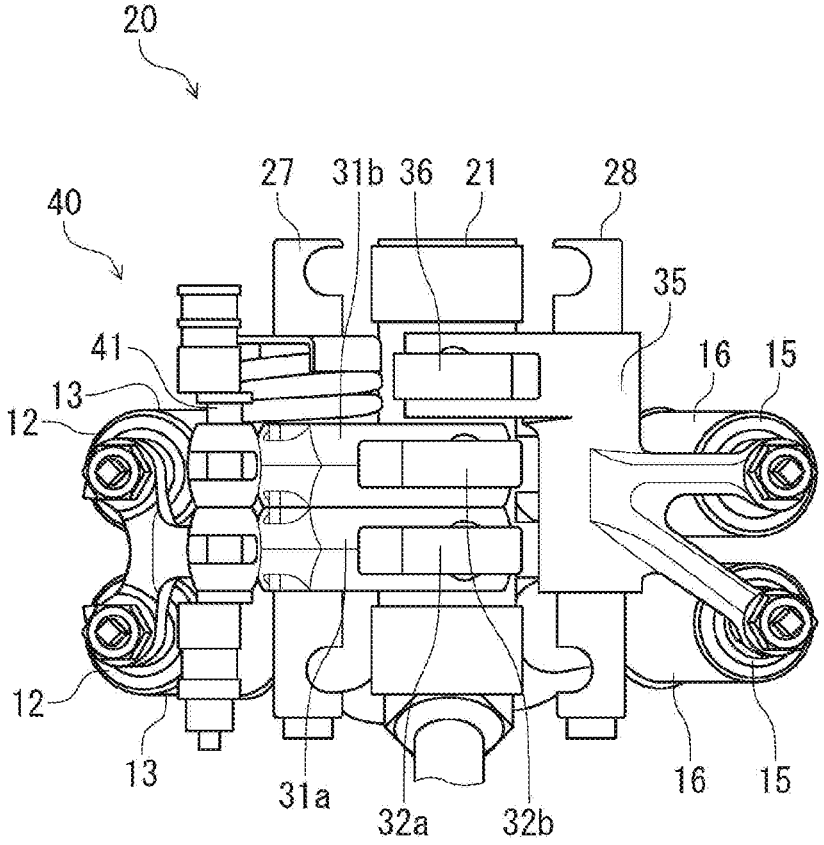
FIG. 2 is a schematic top view of the variable valve device according to the first embodiment.
Figure 3A:
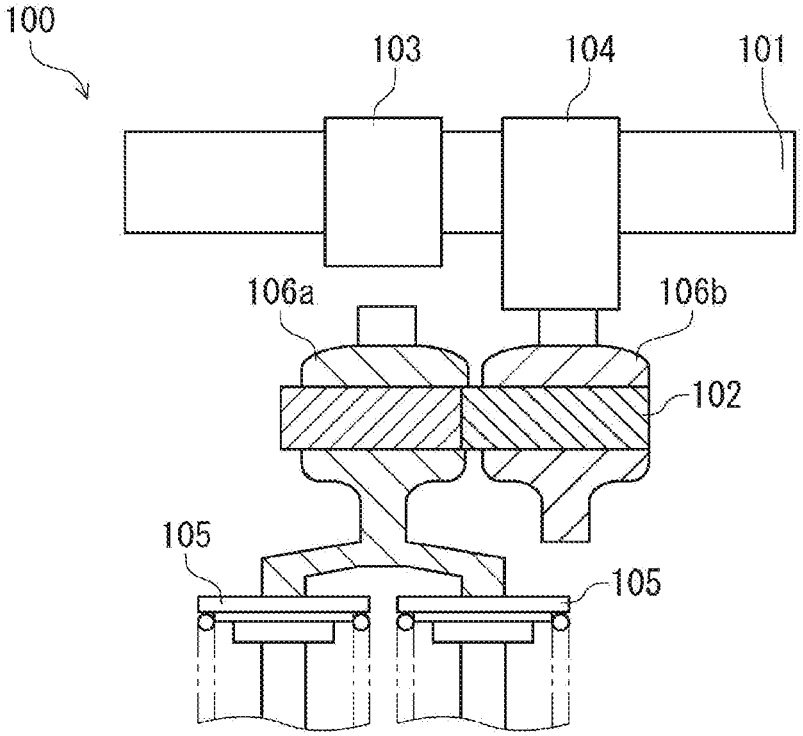
Prior Art FIG. 3A
FIGS. 3A and 3B show an example of switching operation of a cam of a variable valve device according to a comparative example.
Figure 3B:
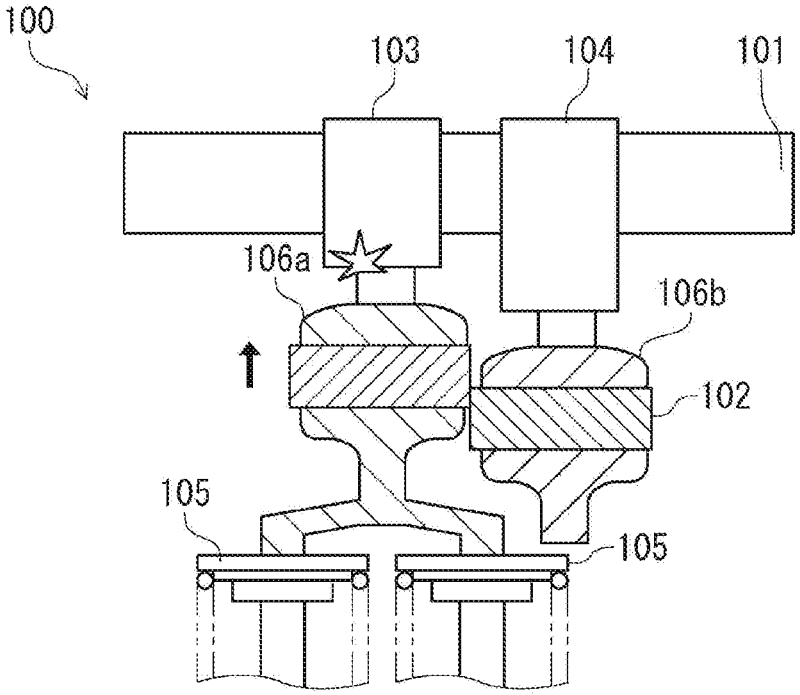
Prior Art FIG. 3B

Hereinafter, a variable valve device according to a first embodiment will be described with reference to the attached drawings. FIG. 1 is a schematic cross-sectional view of the variable valve device according to the first embodiment. FIG. 2 is a schematic top view of the variable valve device according to the first embodiment. FIGS. 3A and 3B show an example of switching operation of a cam of a variable valve device according to a comparative example. In FIG. 2, a cylinder head and a cylinder head cover are omitted.

As shown in FIGS. 1 and 2, a cylinder head 10 is provided with four intake valves 12 for opening and closing intake ports 11 and four exhaust valves 15 for opening and closing exhaust ports 14 (only two of the intake ports and two of the exhaust ports are shown in FIG. 2). The intake valve 12 is pressed in a valve closing direction by a valve spring 13, and the exhaust valve 15 is pressed in a valve closing direction by a valve spring 16. A cylinder head cover 17 is attached to an upper surface of the cylinder head 10, and a valve operating chamber 18 is formed by the cylinder head 10 and the cylinder head cover 17. A variable valve device 20 that changes a valve lift amount in the cylinder head 10 is mounted in the valve operating chamber 18.

The variable valve device 20 is provided with a camshaft 21 common to an intake side and an exhaust side, and an intake-side rocker shaft 27 and an exhaust-side rocker shaft 28 which are parallel to the camshaft 21. The camshaft 21 is rotatably supported in the cylinder head 10. The camshaft 21 is disposed between the intake valves 12 and the exhaust valves 15, and a low-speed cam 23, a high-speed cam 24, and an exhaust cam 25 are formed on an outer circumferential surface of the camshaft 21. Each of the cams 23 to 25 is formed in a plate shape in which a cam peak protrudes from a part of a base circle. A cam peak of the high-speed cam 24 is higher than that of the low-speed cam 23 in order to make a valve lift amount of the high-speed cam 24 larger than that of the low-speed cam 23.

The intake-side rocker shaft 27 and exhaust-side rocker shaft 28 are attached to the cylinder head 10 above the camshaft 21. Rocker arms 31*a*, 31*b* of two types are swingably supported by the intake-side rocker shaft 27 (only one of the rocker arms 31*a* and one of the rocker arms 31*b* are shown in FIG. 2), and a pair of rocker arms 35 are swingably supported by the exhaust-side rocker shaft 28 (only one of the rocker arms 35 is shown in FIG. 2). The intake-side rocker arm 31*a* and the exhaust-side rocker arm 35 are formed in a seesaw shape having a point of effort and a point of load, and the intake-side rocker arm 31*b* is the point of effort of the rocker arm 31*a*.

A roller 32*a*, which is in rolling contact with the low-speed cam 23, is rotatably supported at one end of the intake-side rocker arm 31*a*, and a pair of intake valves 12 are coupled to the other end of the rocker arm 31*a* which branches into two parts. A roller 32*b*, which is in rolling contact with the high-speed cam 24 is rotatably supported at one end of the intake-side rocker arm 31*b*, and the intake valves 12 are not coupled to the other end of the rocker arm 31*b*. A roller 36, which is in rolling contact with the exhaust cam 25, is rotatably supported at one end of the exhaust-side rocker arm 35, and a pair of exhaust valves 15 are coupled to the other end of the rocker arm 35 which branches into two parts. The rocker arms 31*a*, 31*b* can be coupled to each other.

When the engine rotates at a low speed or at a medium speed, the rocker arms 31*a*, 31*b* are not coupled to each other. Therefore, the rocker arm 31*a* is swung by the low-speed cam 23, and the rocker arm 31*b* is swung by the high-speed cam 24. Since a pair of intake valves 12 are coupled to the rocker arm 31*a*, the pair of intake valves 12 are moved as the low-speed cam 23 rotates. Since the cam peak of the low-speed cam 23 is low, the valve lift amount of the pair of intake valves 12 is small. Since the intake valve 12 is not coupled to the rocker arm 31*b*, the rocker arm 31*b* is idling as the high-speed cam 24 rotates.

When the engine rotates at a high speed, the rocker arms 31*a*, 31*b* are coupled to each other. Therefore, the rocker arms 31*a*, 31*b* are integrally swung by the high-speed cam 24. Since a pair of intake valves 12 are coupled to the rocker arm 31*b* via the rocker arm 31*a*, the pair of intake valves 12 are moved as the high-speed cam 24 rotates. Since the cam peak of the high-speed cam 24 is high, the valve lift amount of the pair of intake valves 12 is large. In this way, by switching a coupling state of the rocker arms 31*a*, 31*b*, the low-speed cam 23 and the high-speed cam 24 that move the intake valves 12 are switched.

The variable valve device 20 is provided with a switching mechanism 40 that switches between a coupling state and a non-coupling state of the rocker arms 31*a*, 31*b* by an oil pressure. An accommodation hole is formed in each of the rocker arms 31*a*, 31*b*, and a coupling pin 41 is installed in the accommodation hole of the rocker arm 31*b*. When a part of the coupling pin 41 enters the accommodation hole of the rocker arm 31*a* from the accommodation hole of the rocker arm 31*b*, the rocker arms 31*a*, 31*b* are coupled via the coupling pin 41. When a part of the coupling pin 41 is pushed back from the accommodation hole of the rocker arm 31*a* to the accommodation hole of the rocker arm 31*b*, the coupling between the rocker arms 31*a*, 31*b* is released.

As shown in FIG. 3A, in a variable valve device 100 of a comparative example, a coupling pin 102 is moved regardless of a phase of a camshaft 101. Therefore, in a case where a low-speed cam 103 is switched to a high-speed cam 104, when the coupling pin 102 protrudes from an accommodation hole of a rocker arm 106*b* immediately before a valve lift of intake valves 105, the coupling pin 102 may not sufficiently enter an accommodation hole of a rocker arm 106*a*. As shown in FIG. 3B, when the coupling pin 102 is disengaged from the accommodation hole of the rocker arm 106*a* in the middle of a valve lift performed by the high-speed cam 104 and a coupling state is released, a malfunction occurs in which the rocker arm 106*a* collides with the low-speed cam 103 to generate abnormal noise, and the durability of the variable valve device 100 is reduced.

Therefore, the variable valve device 20 of the present embodiment performs the switching operation between the low-speed cam 23 and the high-speed cam 24 in consideration of a phase of the camshaft 21. At the time of switching from the low-speed cam 23 to the high-speed cam 24, the coupling pin 41 is pushed from the accommodation hole of the rocker arm 31*b* to the accommodation hole of the rocker arm 31*a* while avoiding a valve lift in which the accommodation holes of the rocker arms 31*a*, 31*b* do not match. The rocker arms 31*a*, 31*b* are smoothly coupled by the coupling pin 41, the coupling state of the rocker arms 31*a*, 31*b* is not released during a valve lift performed by the high-speed cam 24, and thus generation of abnormal noise is suppressed.

Figure 4:
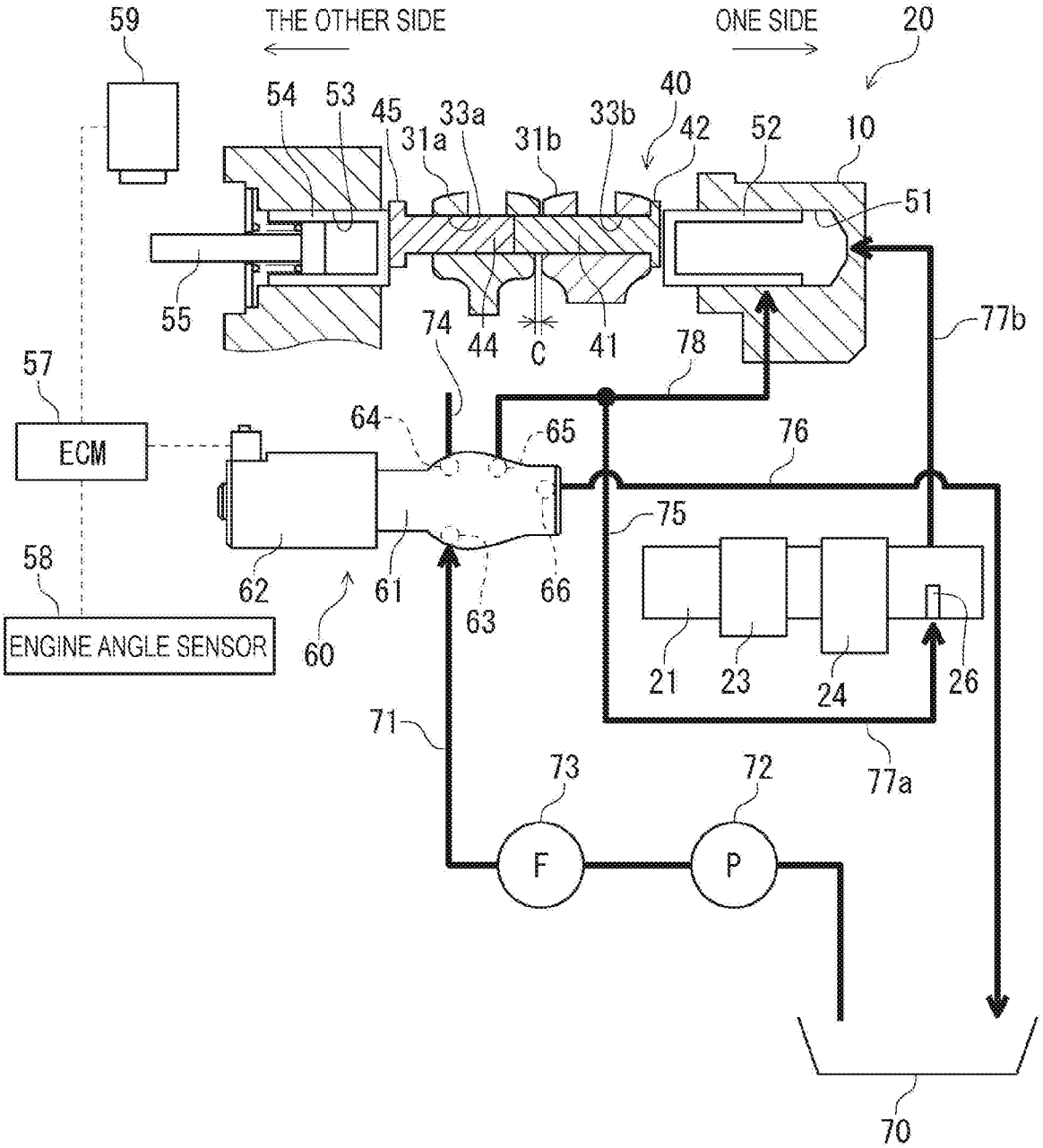
FIG. 4 is a schematic diagram of the variable valve device according to the first embodiment.
Figure 5:
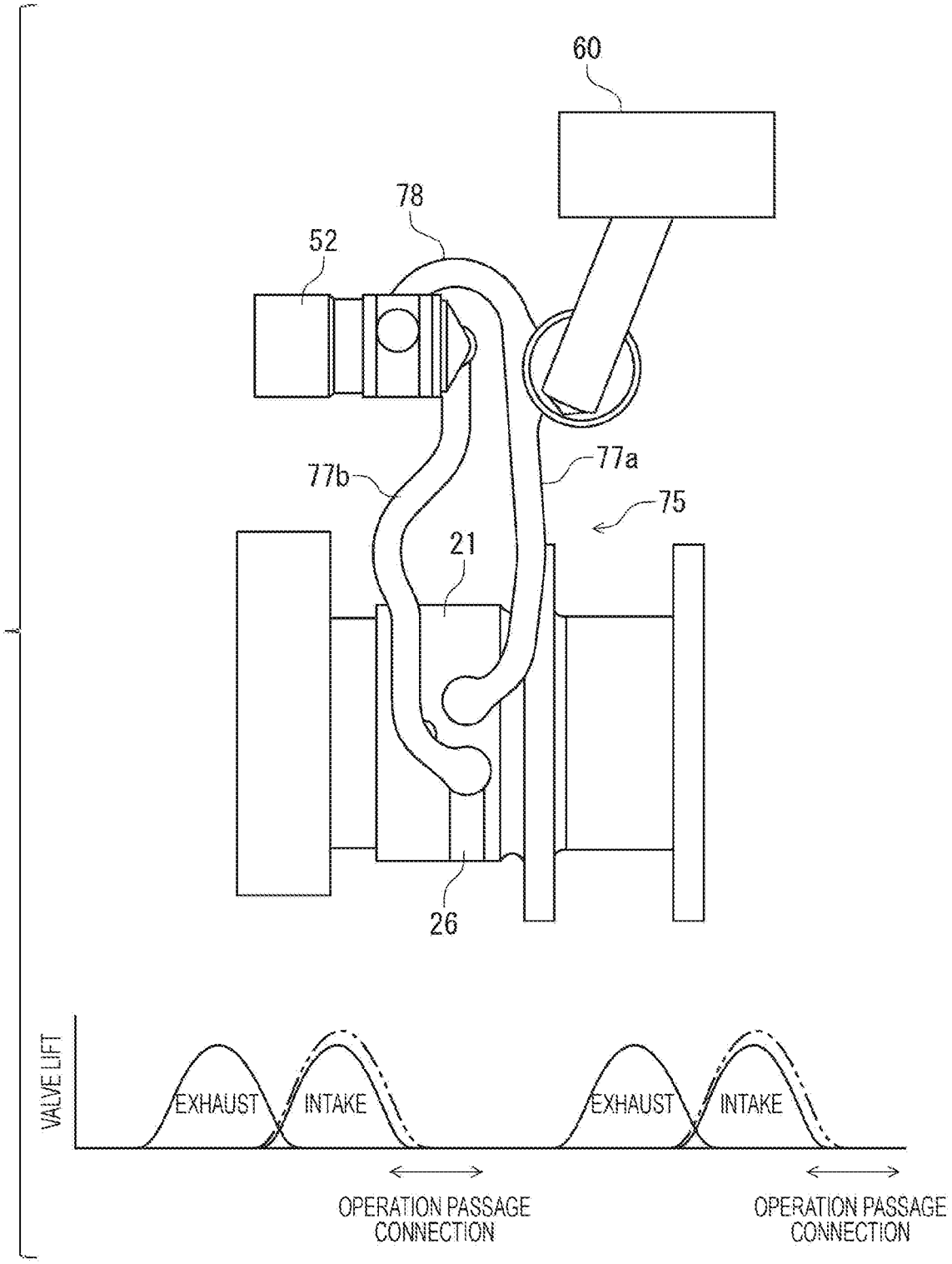
FIG. 5 is a schematic diagram of an operation passage and a shortcut passage according to the first embodiment.
Figure 6A:
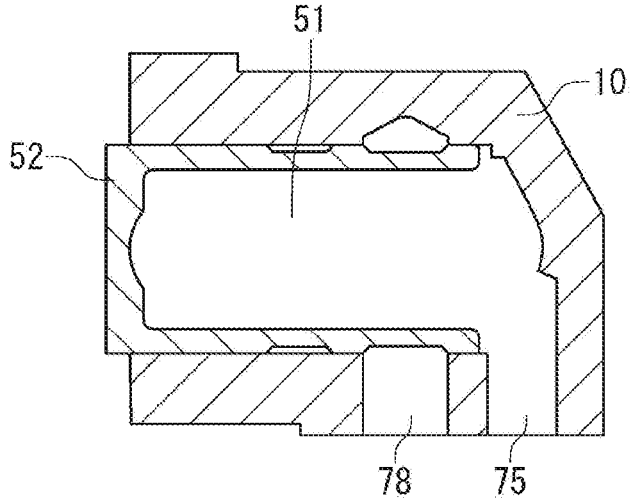
FIGS. 6A to 6C are views illustrating movement operation of a hydraulic piston according to the first embodiment.
Figure 6B:
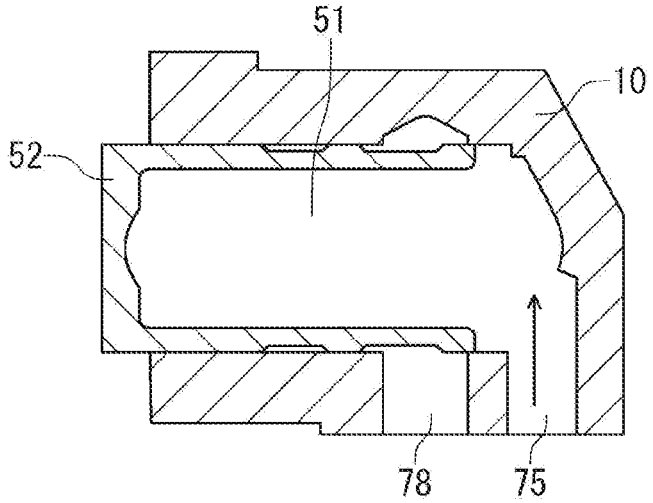
Figure 6C:
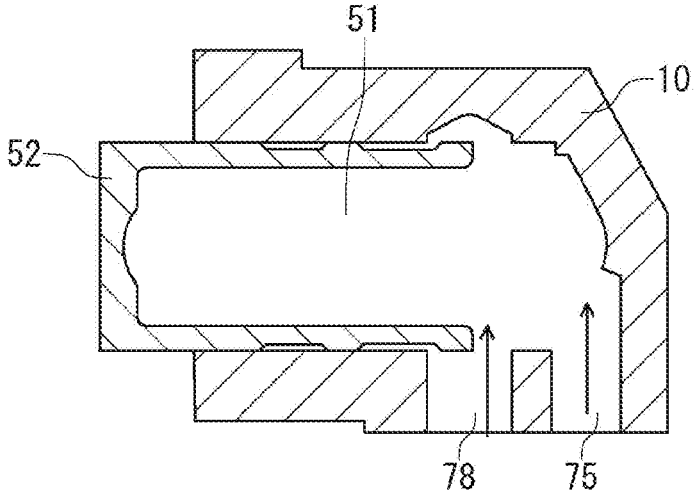

Hereinafter, the variable valve device according to the first embodiment will be described with reference to FIGS. 4 to 6C. FIG. 4 is a schematic diagram of the variable valve device according to the first embodiment. FIG. 5 is a schematic diagram of an operation passage and a shortcut passage according to the first embodiment. FIGS. 6A to 6C are views illustrating movement operation of a hydraulic piston according to the first embodiment.

As shown in FIG. 4, in the variable valve device 20, an oil supply path 71 extends from the oil pan 70 toward an oil control valve 60. Oil is pumped up from the oil pan 70 by an oil pump 72 in the middle of the oil supply path 71, and the oil is supplied to the oil control valve 60 through an oil filter 73. The oil control valve 60 is formed by a valve housing 61 in which a valve spool (not shown) is accommodated, and a solenoid 62 that moves the valve spool forward and backward. When the valve spool is moved forward and backward by the solenoid 62, an oil passage in the oil control valve 60 is switched.

An input port 63, a low-speed port 64, a high-speed port 65, and a drain port 66 are formed in the valve housing 61. The oil supply path 71 is connected with the input port 63, a dead-end passage 74 is connected with the low-speed port 64, an operation passage (oil passage) 75 is connected with the high-speed port 65, and a drain passage 76 is connected with the drain port 66. An output destination of the dead-end passage 74 is closed, and the operation passage 75 extends from the oil control valve 60 toward the switching mechanism 40. The drain passage 76 extends from the oil control valve 60 to a position above the oil pan 70, and the oil drops from an outlet of the drain passage 76 into the oil pan 70.

By moving the valve spool of the oil control valve 60, the input port 63 is connected to any one of the low-speed port 64 and the high-speed port 65, and the drain port 66 is connected to the other of the low-speed port 64 and the high-speed port 65. The oil is output from the oil control valve 60 to any one of the dead-end passage 74 and the operation passage 75, and excess oil is discharged from the other of the dead-end passage 74 and the operation passage 75 to the oil control valve 60 (drain passage 76). In this way, an oil pressure for the switching mechanism 40 is controlled by the oil control valve 60.

A part of the operation passage 75 extending from the oil control valve 60 to the switching mechanism 40 is formed by an oil groove 26 of the camshaft 21. As described above, the low-speed cam 23, the high-speed cam 24, and the exhaust cam 25 (not shown in FIG. 4) are formed on the camshaft 21, and the oil groove 26 is formed in a part of the outer circumferential surface of the camshaft 21 supported by a cam housing (not shown). By rotating the camshaft 21, connection and separation between an upstream passage 77*a* and a downstream passage 77*b* of the operation passage 75 are alternately repeated. Therefore, the oil is intermittently supplied from the oil control valve 60 to the switching mechanism 40 through the operation passage 75.

Further, a shortcut passage (another oil passage) 78 is branched from the upstream passage 77*a* of the operation passage 75. The shortcut passage 78 extends directly from the oil control valve 60 to the switching mechanism 40 without passing through the oil groove 26 of the camshaft 21. Therefore, the oil is continuously supplied from the oil control valve 60 to the switching mechanism 40 through the shortcut passage 78. As will be described in detail later, the oil supply through the operation passage 75 is used as a trigger for moving a hydraulic piston 52 of the switching mechanism 40, and the oil supply through the shortcut passage 78 is used to hold the hydraulic piston 52 in a push-out state.

As described above, the rocker arms 31*a*, 31*b* are adjacent to each other, but upper portions of the rocker arms 31*a*, 31*b* face each other with a slight gap C therebetween. Accommodation holes 33*a*, 33*b* parallel to the camshaft 21 are formed in the upper portions of the rocker arms 31*a*, 31*b*. The accommodation hole 33*a* of the rocker arm 31*a* and the accommodation hole 33*b* of the rocker arm 31*b* have the same hole diameter, and are coaxially formed such that the accommodation holes 33*a*, 33*b* are in communication with each other in a non-lift-up state. The coupling pin 41 is provided in the accommodation hole 33*b* of the rocker arm 31*b*, and a return pin 44 is provided in the accommodation hole 33*a* of the rocker arm 31*a*.

The accommodation holes 33*a*, 33*b* of the rocker arms 31*a*, 31*b* are formed straight, and flange pins are used as the coupling pin 41 and the return pin 44. A flange 42 is formed at one end of the coupling pin 41 protruding from the rocker arm 31*b* to one side, and a flange 45 is formed at the other end of the return pin 44 protruding from the rocker arm 31*a* to the other side. In this case, the flange 42 of the coupling pin 41 abuts against the rocker arm 31*b* to restrict pushing of the coupling pin 41, and the flange 45 of the return pin 44 abuts against the rocker arm 31*a* to restrict pushing back of the return pin 44.

In the cylinder head 10, a sliding chamber 51 is formed on one side of the rocker arm 31*b*, and the hydraulic piston 52 is installed in the sliding chamber 51. A pressing surface of the hydraulic piston 52 is in contact with the coupling pin 41, and the coupling pin 41 is moved to the other side by the hydraulic piston 52. Further, in the cylinder head 10, a sliding chamber 53 is formed on the other side of the rocker arm 31*a*. A spring pin 54 is installed in the sliding chamber 53. A pressing surface of the spring pin 54 is in contact with the return pin 44, and the return pin 44 is returned to the one side by the spring pin 54. A sensing arm 55 extends from the spring pin 54 to the other side.

In the switching mechanism 40, the coupling state of the rocker arms 31*a*, 31*b* is switched by the coupling pin 41 being moved by the oil pressure. As described above, in the non-coupling state of the rocker arms 31*a*, 31*b*, the pair of intake valves 12 are operated by the low-speed cam 23 via the rocker arm 31*a*. In the coupling state of the rocker arms 31*a*, 31*b*, the pair of intake valves 12 are operated by the high-speed cam 24 via the rocker arms 31*a*, 31*b*. In this way, in the switching mechanism 40, the cam that moves the pair of intake valves 12 is switched by switching the coupling state of the rocker arms 31*a*, 31*b* by the coupling pin 41.

The variable valve device 20 includes an engine control module (ECM) 57, an engine angle sensor 58, and a switching sensor 59. An engine rotation speed is detected by the engine angle sensor 58, and a coupling command signal is output from the ECM 57 to the solenoid 62 when the engine rotation speed is equal to or higher than a predetermined rotation speed, and a release command signal is output from the ECM 57 to the solenoid 62 when the engine rotation speed is lower than the predetermined rotation speed. The switching sensor 59 detects the switching between the coupling state and the non-coupling state of the rocker arms 31*a*, 31*b* based on movement of a tip end of the sensing arm 55. A failure of the variable valve device 20 such as a switching operation failure is determined by comparing a command signal of the ECM 57 with a detection signal of the switching sensor 59.

As shown in FIG. 5, the upstream passage 77*a* of the operation passage 75 extends from the oil control valve 60 toward the camshaft 21, and the downstream passage 77*b* of the operation passage 75 extends from the camshaft 21 toward the hydraulic piston 52 of the switching mechanism 40. A downstream end of the upstream passage 77*a* and an upstream end of the downstream passage 77*b* are positioned on the same circumference on the outer circumferential surface of the camshaft 21. The oil groove 26 is formed in a circumferential direction on the circumference of the outer circumferential surface of the camshaft 21. The oil groove 26 functions as the operation passage 75 for supplying the oil to the hydraulic piston 52 in both the upstream passage 77*a* and the downstream passage 77*b*.

The oil is supplied from the oil control valve 60 to the hydraulic piston 52 only while the upstream passage 77*a* and the downstream passage 77*b* are connected via the oil groove 26. At this time, the oil groove 26 is formed such that the upstream passage 77*a* and the downstream passage 77*b* are connected at an end timing of a valve lift, and the upstream passage 77*a* and the downstream passage 77*b* are separated from each other before a valve lift starts. That is, the oil groove 26 is formed such that the oil starts to be supplied from the oil control valve 60 to the hydraulic piston 52 at an end timing of a valve lift, and the supply of the oil to the hydraulic piston 52 ends before a valve lift starts.

Since the oil starts to be supplied to the hydraulic piston 52 at an end timing of a valve lift, coupling operation of the rocker arms 31*a*, 31*b* is not hindered by the valve lift. Further, since the coupling operation of the rocker arms 31*a*, 31*b* ends before a valve lift starts, the rocker arms 31*a*, 31*b* are not coupled in the middle of the valve lift. Therefore, the oil is intermittently supplied from the oil control valve 60 to the hydraulic piston 52 through the operation passage 75 as the camshaft 21 rotates, and the rocker arms 31*a*, 31*b* can be smoothly coupled to each other through the coupling pin 41.

The shortcut passage 78 extends directly from the oil control valve 60 to the hydraulic piston 52. The shortcut passage 78 is shorter than the operation passage 75. A stepwise oil supply structure for the hydraulic piston 52 is formed such that the oil is supplied to the hydraulic piston 52 from the shortcut passage 78 after the oil is supplied to the hydraulic piston 52 from the operation passage 75. Although the hydraulic piston 52 may move only by the intermittent supply of the oil from the operation passage 75, the hydraulic piston 52 is stably held by the direct supply of the oil from the shortcut passage 78.

As shown in FIG. 6A, the hydraulic piston 52 is installed in the cylindrical sliding chamber 51 of the cylinder head 10. A downstream end of the operation passage 75 (the downstream passage 77*b*) is opened in an inner bottom surface of the sliding chamber 51, and a downstream end of the shortcut passage 78 is opened in an inner circumferential surface of the sliding chamber 51. A supply direction of the oil from the operation passage 75 to the hydraulic piston 52 is directed to an advancing direction of the hydraulic piston 52, and a supply direction of the oil from the shortcut passage 78 to the hydraulic piston 52 is directed to a radial direction of the hydraulic piston 52. When the hydraulic piston 52 is in a retracted position, the downstream end of the shortcut passage 78 is closed by an outer circumferential surface of the hydraulic piston 52.

As shown in FIG. 6B, when the engine rotation speed increases from low to high, the oil is supplied from the downstream end of the operation passage 75 to the sliding chamber 51. Since the supply direction of the oil from the operation passage 75 is directed to the advancing direction of the hydraulic piston 52, the hydraulic piston 52 is smoothly moved in the advancing direction. As shown in FIG. 6C, when the hydraulic piston 52 moves in the advancing direction, the downstream end of the shortcut passage 78 is opened, and the oil is supplied from the downstream end of the shortcut passage 78 to the sliding chamber 51. The oil from the shortcut passage 78 holds the hydraulic piston 52 at an advancing position protruding from the sliding chamber 51.

As described above, when the hydraulic piston 52 is moved from the retracted position to the advancing position, intermittent oil supply to the hydraulic piston 52 from the operation passage 75 is switched to continuous oil supply from the shortcut passage 78. Since the shortcut passage 78 is shorter than the operation passage 75, the oil is smoothly supplied from the shortcut passage 78 to the hydraulic piston 52, and the hydraulic piston 52 can be stably held. Since the downstream end of the shortcut passage 78 is opened and closed by the hydraulic piston 52, the number of components can be reduced and the variable valve device 20 can be formed in a compact manner.

Figure 7A:
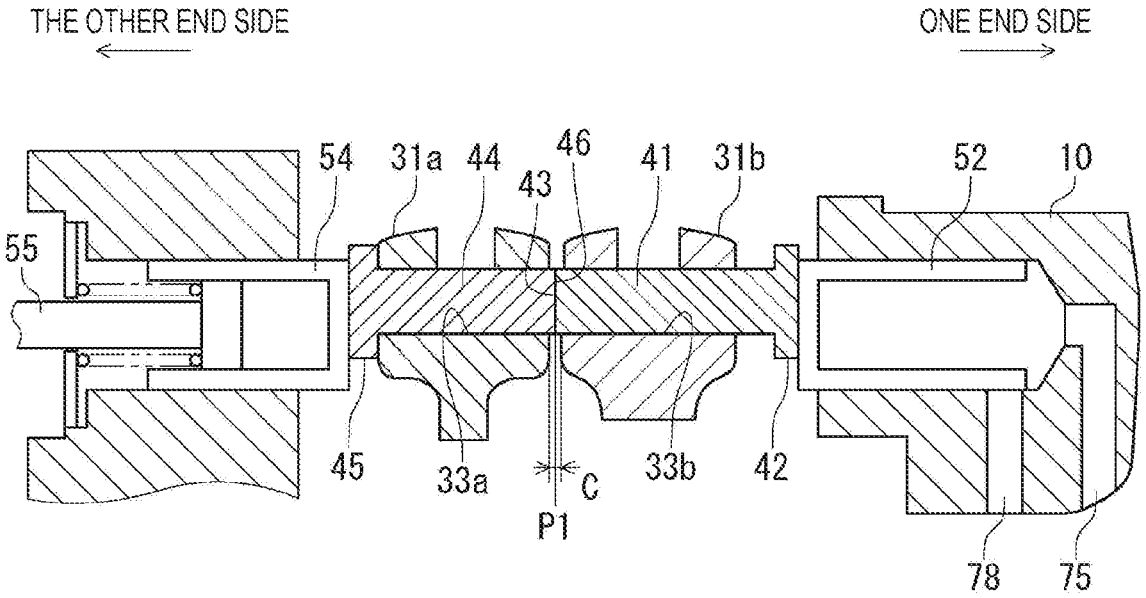
FIGS. 7A and 7B are views illustrating coupling operation of the variable valve device according to the first embodiment.
Figure 7B:
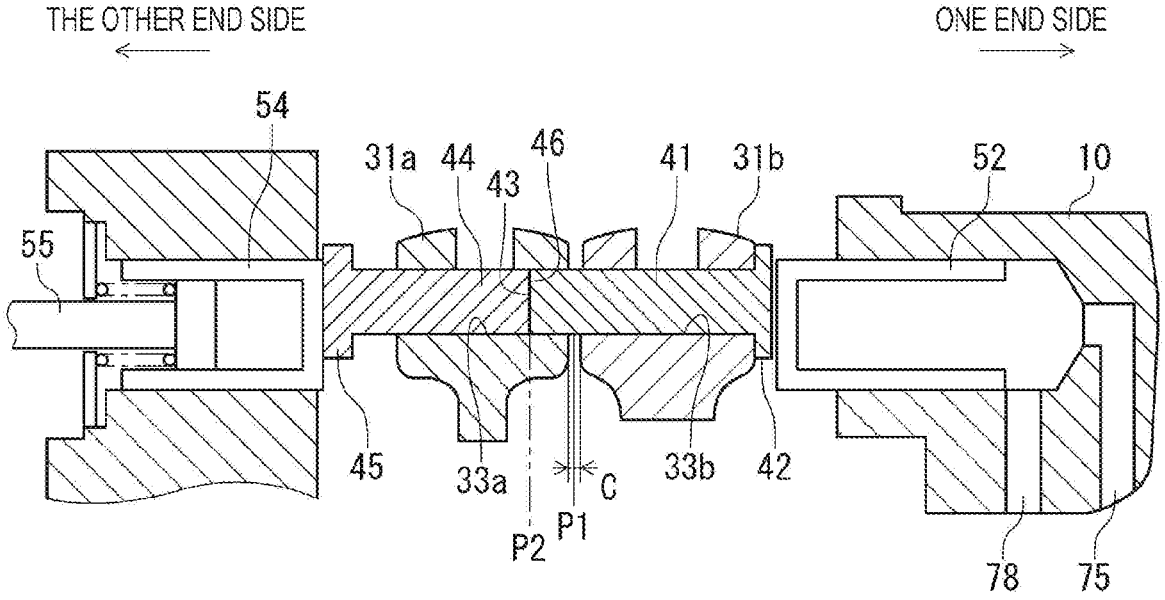

The coupling operation of the variable valve device will be described with reference to FIGS. 7A and 7B. FIGS. 7A and 7B are views illustrating the coupling operation of the variable valve device according to the first embodiment. In FIGS. 7A and 7B, for convenience of description, the reference numerals in FIG. 4 are used as appropriate.

As shown in FIG. 7A, at the time of low rotation of the engine, the oil is not supplied from the oil control valve 60 to the hydraulic piston 52. A pressing force is not applied from the hydraulic piston 52 to the coupling pin 41, and a spring force of the spring pin 54 is applied to the return pin 44. The flange 45 of the return pin 44 abuts against the rocker arm 31*a*, and the return pin 44 is positioned at an initial position. At this time, the other end 43 of the coupling pin 41 is in contact with one end 46 of the return pin 44 at a non-coupling position P1 in the gap C between the rocker arms 31*a*, 31*b*. The other end 43 of the coupling pin 41 is located outside the rocker arm 31*b*, and the rocker arms 31*a*, 31*b* are separated from each other.

As shown in FIG. 7B, when the engine rotation speed increases to a predetermined rotation speed or more, the oil starts to be supplied from the oil control valve 60 to the hydraulic piston 52. As the camshaft 21 rotates, the upstream passage 77*a* and the downstream passage 77*b* of the operation passage 75 are intermittently connected through the oil groove 26, and the oil is intermittently supplied from the operation passage 75 to the hydraulic piston 52. At this time, the oil starts to be supplied at an end timing of a valve lift of the intake valves 12 in order not to hinder the coupling operation of the rocker arms 31*a*, 31*b*. Therefore, the hydraulic piston 52 is smoothly pushed out in the advancing direction by the oil from the operation passage 75.

The coupling pin 41 is pushed in by the hydraulic piston 52, and the spring pin 54 is moved to the other side by the coupling pin 41 via the return pin 44. The other end 43 of the coupling pin 41 is moved to the other side from the non-coupling position P1 to a coupling position P2 of the rocker arm 31*a*. When a part of the coupling pin 41 enters the accommodation hole 33*a* of the rocker arm 31*a*, the rocker arms 31*a*, 31*b* are coupled to each other via the coupling pin 41. The downstream end of the shortcut passage 78 is opened by the movement of the hydraulic piston 52, and the position of the hydraulic piston 52 is maintained by the continuous oil supply from the shortcut passage 78.

As shown in FIG. 7A, when the engine rotation speed decreases to less than the predetermined rotation speed, the oil is returned from the hydraulic piston 52 to the oil control valve 60 (drain passage 76). The pushing in of the coupling pin 41 performed by the hydraulic piston 52 is released, the return pin 44 is pushed by a repulsive force of the spring pin 54, and the coupling pin 41 is pushed back to the one side by the return pin 44. The other end 43 of the coupling pin 41 is moved to the one side from the coupling position P2 to the non-coupling position P1. Then, when the part of the coupling pin 41 is pulled out of the accommodation hole 33*a* of the rocker arm 31*a*, the coupling between the rocker arms 31*a*, 31*b* is released.

As described above, according to the variable valve device 20 of the first embodiment, since the oil starts to be supplied from the oil control valve 60 to the switching mechanism 40 at an end timing of a valve lift, the coupling operation of the rocker arms 31*a*, 31*b* is not hindered by the valve lift, and the rocker arms 31*a*, 31*b* are appropriately coupled by the coupling pin 41. Therefore, the coupling state of the rocker arms 31*a*, 31*b* is not released in the middle of the valve lift, the generation of abnormal noise is suppressed, and the durability of the variable valve device 20 is improved.

Second Embodiment

Figure 8:
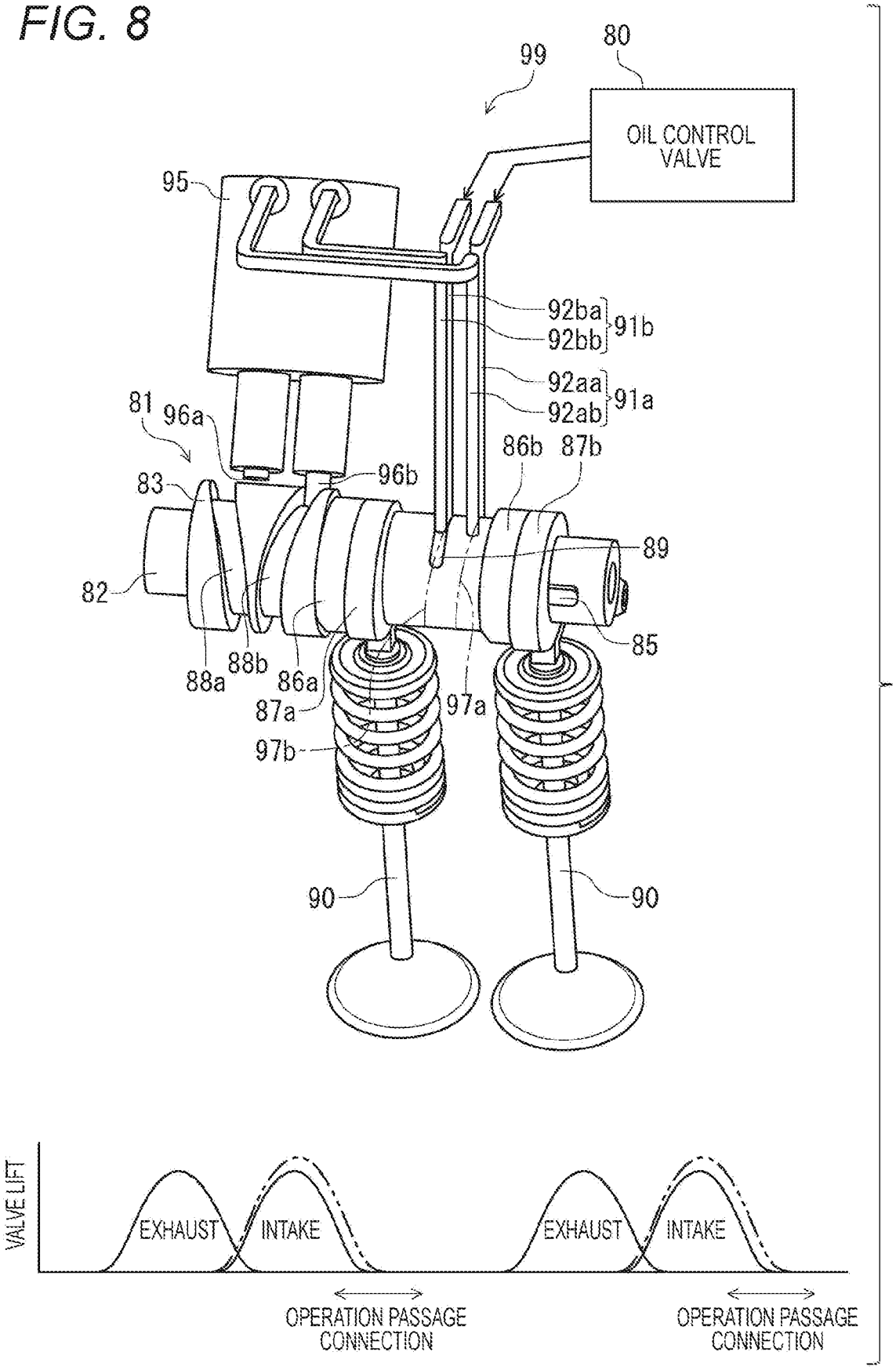
FIG. 8 is a perspective view of a variable valve device according to a second embodiment.

Next, a variable valve device according to a second embodiment will be described with reference to FIGS. 8 to 10B. The variable valve device of the second embodiment is different from the variable valve device of the first embodiment in that a cam for moving an intake valve is switched by a shift cam. Therefore, in the second embodiment, description of the same configuration as that of the first embodiment will be omitted. FIG. 8 is a perspective view of the variable valve device according to the second embodiment. FIGS. 9A to 10B are views illustrating switching operation of the variable valve device according to the second embodiment.

As shown in FIG. 8, a shift cam 83 is slidably and integrally rotatably provided on a shaft main body 82 of a camshaft 81 of the second embodiment. A guide groove (not shown) is formed in an axial direction of the shift cam 83 on an inner circumferential surface of the shift cam 83, and a guide rail 85 that enters the guide groove is formed in the axial direction on an outer circumferential surface of the shaft main body 82. On an outer circumferential surface of the shift cam 83, low-speed cams 86*a*, 86*b* and high-speed cams 87*a*, 87*b* are formed, and switching grooves 88*a*, 88*b* for sliding the shift cam 83 with respect to the shaft main body 82 are formed. A single oil groove 89 for connection of each of the oil passages 91*a*, 91*b* is formed in the outer circumferential surface of the shift cam 83.

A pair of intake valves 90 are provided corresponding to the low-speed cams 86*a*, 86*b* and the high-speed cams 87*a*, 87*b*, and a hydraulic switching switch (switching mechanism) 95 is provided corresponding to the switching grooves 88*a*, 88*b*. The switching switch 95 is provided with switching pins 96*a*, 96*b* that enter the switching grooves 88*a*, 88*b* by oil pressure, and when the switching pins 96*a*, 96*b* selectively enter the switching grooves 88*a*, 88*b*, the shift cam 83 is slid and the cam is switched. The switching pin 96*a* is inserted into the switching groove 88*a* to switch to the high-speed cams 87*a*, 87*b*, and the switching pin 96*b* is inserted into the switching groove 88*b* to switch to the low-speed cams 86*a*, 86*b*.

A part of the oil passages 91*a*, 91*b* extending from an oil control valve 80 to the switching pins 96*a*, 96*b* is formed by the oil groove 89. An upstream passage 92*aa* of the oil passage 91*a* extends from the oil control valve 80 toward the shift cam 83, and a downstream passage 92*ab* of the oil passage 91*a* extends from the shift cam 83 toward the switching pin 96*a*. A downstream end of the upstream passage 92*aa* and an upstream end of the downstream passage 92*ab* are positioned on the same circumference 97*a* on the outer circumferential surface of the shift cam 83. When the low-speed cams 86*a*, 86*b* are used, the oil groove 89 is positioned on the circumference 97*a*.

An upstream passage 92*ba* of the oil passage 91*b* extends from the oil control valve 80 toward the shift cam 83, and a downstream passage 92*bb* of the oil passage 91*b* extends from the shift cam 83 toward the switching pin 96*b*. A downstream end of the upstream passage 92*ba* and an upstream end of the downstream passage 92*bb* are positioned on the same circumference 97*b* on the outer circumferential surface of the shift cam 83. When the high-speed cams 87*a*, 87*b* are used, the oil groove 89 is positioned on the circumference 97*b*. By sliding the shift cam 83, connection states of the oil passages 91*a*, 91*b* are controlled by the one oil groove 89.

In a state where the oil groove 89 is positioned on the circumference 97*a*, the upstream passage 92*aa* and the downstream passage 92*ab* are intermittently connected through the oil groove 89. At this time, the oil groove 89 is formed such that the upstream passage 92*aa* and the downstream passage 92*ab* are connected at an end timing of a valve lift, and the upstream passage 92*aa* and the downstream passage 92*ab* are separated from each other before a valve lift starts. That is, the oil groove 89 is formed such that the oil starts to be supplied from the oil control valve 80 to the switching pin 96*a* at an end timing of a valve lift, and the supply of the oil to the switching pin 96*a* ends before a valve lift starts.

Since the oil starts to be supplied to the switching pin 96*a* at an end timing of a valve lift, the switching operation of the shift cam 83 is not hindered by the valve lift. In addition, since the switching operation of the shift cam 83 ends before a valve lift starts, the shift cam 83 is not switched in the middle of the valve lift. In a state where the oil groove 89 is positioned on the circumference 97*b*, the upstream passage 92*ba* and the downstream passage 92*bb* are intermittently connected through the oil groove 89. When the oil is supplied to the switching pin 96*b*, the switching operation of the shift cam 83 is also performed while avoiding the valve lift.

Figure 9A:
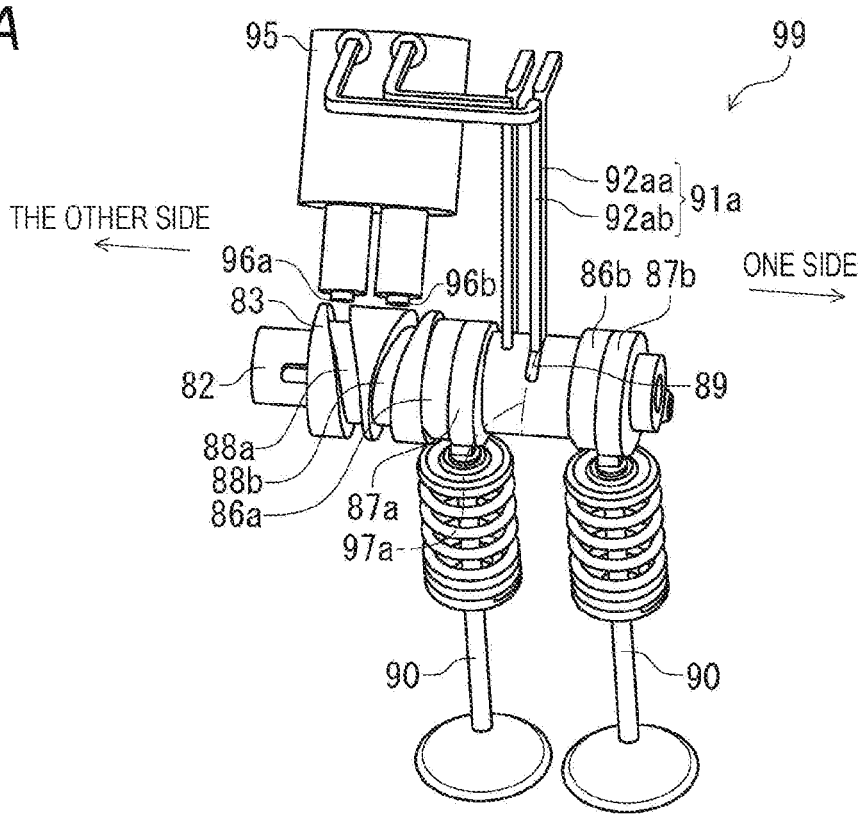
FIGS. 9A and 9B are views illustrating switching operation of the variable valve device according to the second embodiment.

As shown in FIG. 9A, when the engine rotates at a low speed, the oil is not supplied from the oil control valve 80 to the switching switch 95. The switching pins 96*a*, 96*b* of the switching switch 95 are pressed in a retraction direction by an internal spring. Since the switching pins 96*a*, 96*b* are pulled out of the switching grooves 88*a*, 88*b*, no force is applied to the shift cam 83 in a sliding direction. At this time, the low-speed cams 86*a*, 86*b* of the shift cam 83 are positioned on the pair of intake valves 90, and the pair of intake valves 90 are lifted by the low-speed cams 86*a*, 86*b*. Further, the oil groove 89 is positioned on the circumference 97*a*.

Figure 9B:
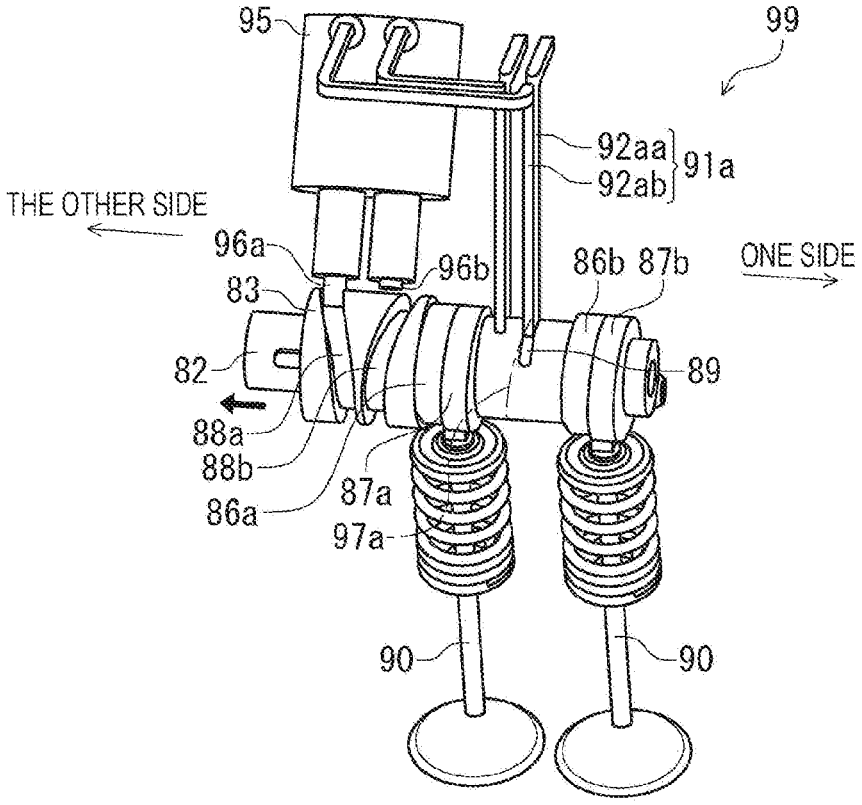

As shown in FIG. 9B, when the engine rotation speed increases to a predetermined rotation speed or more, the oil starts to be supplied from the oil control valve 80 to the switching switch 95. As the camshaft 81 rotates, the upstream passage 92*aa* and the downstream passage 92*ab* of the oil passage 91*a* are intermittently connected through the oil groove 89, and the oil is intermittently supplied from the oil passage 91*a* to the switching pin 96*a*. The switching pin 96*a* enters the switching groove 88*a*, and the shift cam 83 is slid to the other side. Since the oil starts to be supplied at an end timing of a valve lift of the intake valves 90, the sliding of the shift cam 83 is not hindered by the valve lift.

Figure 10A:
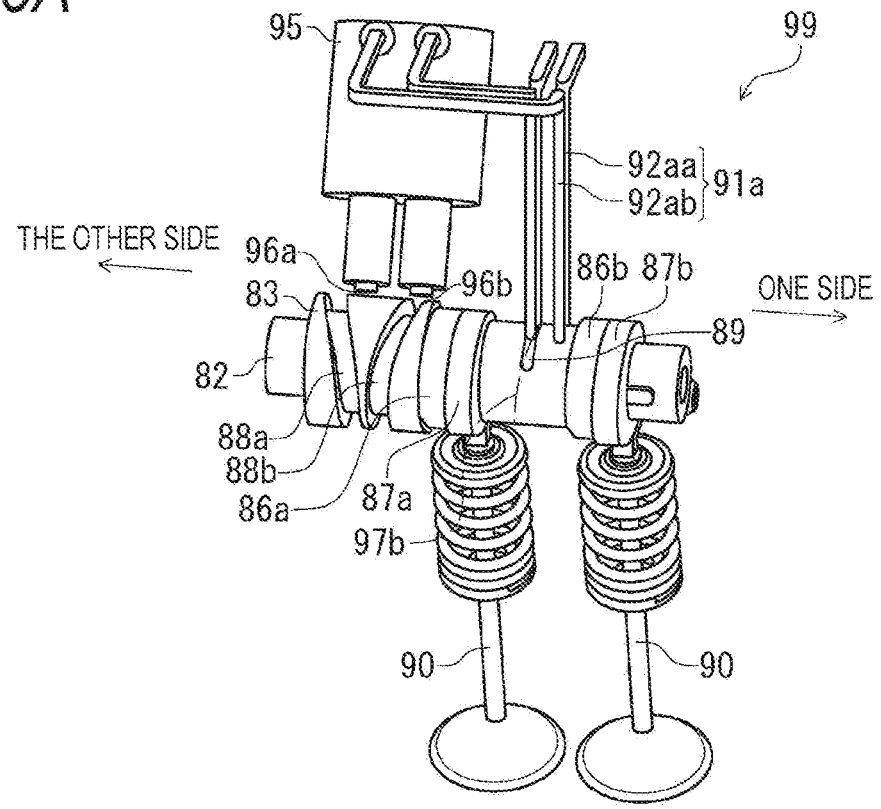
FIGS. 10A and 10B are views illustrating the switching operation of the variable valve device according to the second embodiment.

As shown in FIG. 10A, the supply of oil from the oil control valve 80 to the switching switch 95 is stopped, and the switching pin 96*a* is pulled out of the switching groove 88*a* by a repulsive force of the internal spring, and the sliding of the shift cam 83 is ended. Since the switching pins 96*a*, 96*b* are pulled out of the switching grooves 88*a*, 88*b*, no force is applied to the shift cam 83 in a sliding direction. At this time, the high-speed cams 87*a*, 87*b* of the shift cam 83 are positioned on the pair of intake valves 90, and the pair of intake valves 90 are lifted by the high-speed cams 87*a*, 87*b*. Further, the oil groove 89 is positioned on the circumference 97*b*.

Figure 10B:
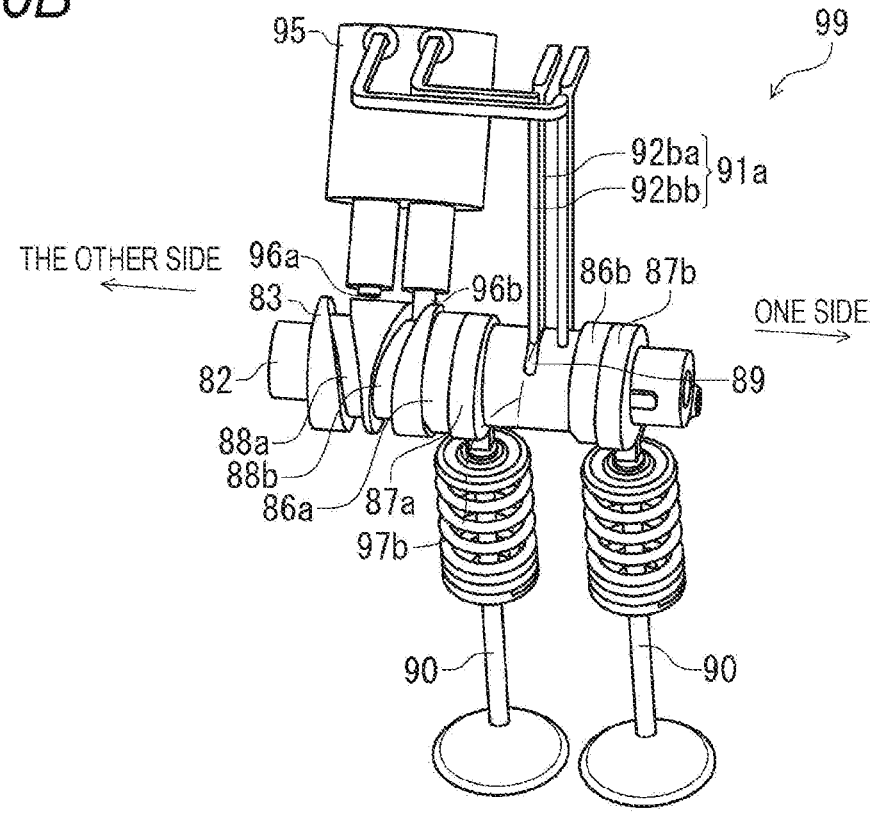

As shown in FIG. 10B, when the engine rotation speed decreases to less than the predetermined rotation speed, the oil starts to be supplied from the oil control valve 80 to the switching switch 95. As the camshaft 81 rotates, the upstream passage 92*ba* and the downstream passage 92*bb* of the oil passage 91*b* are intermittently connected through the oil groove 89, and the oil is intermittently supplied from the oil passage 91*b* to the switching pin 96*b*. The switching pin 96*b* enters the switching groove 88*b*, and the shift cam 83 is slid to the one side. Since the oil starts to be supplied at an end timing of a valve lift of the intake valves 90, the sliding of the shift cam 83 is not hindered by the valve lift.

As described above, according to the variable valve device 99 of the second embodiment, since the oil starts to be supplied from the oil control valve 80 to the switching switch 95 at an end timing of a valve lift, the cam is not switched in the middle of the valve lift. Therefore, generation of abnormal noise is suppressed, and the durability of the variable valve device 99 is improved.

In the first and second embodiments, the end timing of the valve lift is not limited to a timing at which the valve lift is completely ended, and includes a timing immediately before the end at which the valve lift can be regarded as being ended.

In the first and second embodiments, the oil starts to be supplied from the oil control valve to the switching mechanism (hydraulic piston, switching switch) at the end timing of the valve lift, but the oil supply timing is not limited to the end timing of the valve lift. The oil may start to be supplied from the oil control valve to the switching mechanism in a zero range in which no valve lift occurs. With such a configuration, the switching operation of the cam can also be suppressed from being hindered by the valve lift.

In the first and second embodiments, the oil groove is formed such that the supply of the oil to the switching mechanism (the hydraulic piston, the switching switch) through the oil passage ends before the valve lift starts, but the oil groove may be formed longer. For example, the oil groove may be formed such that the supply of the oil to the switching mechanism through the oil passage ends after the valve lift ends and before a next valve lift starts. With this configuration, a long supply time of the oil to the switching mechanism through the oil passage can be secured, and the switching operation of the cam performed by the switching mechanism can be stabilized.

Further, in the first embodiment, the flange pins are used as the coupling pin and the return pin, but straight pins may be used as the coupling pin and the return pin.

In the first embodiment, a seesaw type rocker arm is described as an example, but the type of rocker arm is not particularly limited, and a finger follower type rocker arm may be used.

Further, in the first embodiment, a pair of rocker arms are provided on the intake side of the variable valve device, but a plurality of rocker arms may be provided on the intake side of the variable valve device. For example, three or more rocker arms may be provided on the intake side of the variable valve device.

Further, in the first embodiment, the plurality of rocker arms are adjacent to each other, but the plurality of rocker arms may be separated from each other.

In the first embodiment, the operation passage and the shortcut passage are formed in the cylinder head, but it is sufficient that at least the operation passage is formed in the cylinder head.

Further, the variable valve device of the present embodiment is not limited to being used in an engine of a saddle-type vehicle described above, and may be used in an engine of another type of vehicle. The saddle-type vehicle is not limited to a motorcycle, and may be any vehicle on which an engine is mounted. The saddle-type vehicle is not limited to general vehicles in which a driver rides in a posture of straddling a seat, and includes a scooter type vehicle in which a driver rides without straddling a seat.

As described above, a variable valve device (20) provided in a cylinder head (10) and capable of changing a valve lift amount includes: a camshaft (21, 81) on which a plurality of cams (low-speed cams 23, 86*a*, 86*b*, high-speed cams 24, 87*a*, 87*b*) with different valve lift amounts are formed; a switching mechanism (40, switching switch 95) configured to switch a cam for moving a valve (intake valves 12, 90) among the plurality of cams; and an oil control valve (60, 80) configured to control an oil pressure for the switching mechanism, and oil starts to be supplied from the oil control valve to the switching mechanism at an end timing of a valve lift or in a zero range in which no valve lift occurs. According to the configuration, since the oil starts to be supplied from the oil control valve to the switching mechanism at an end timing of a valve lift or in the zero range, the switching operation of the cam is not hindered by the valve lift. Therefore, occurrence of abnormal noise caused by a malfunction in the switching operation of the cam is suppressed, and the durability of the variable valve device is improved.

The variable valve device further includes: a plurality of rocker arms (31*a*, 31*b*) configured to abut with the plurality of cams to move the valve, the switching mechanism includes a coupling pin (41) configured to couple the plurality of rocker arms and a hydraulic piston (52) configured to move the coupling pin, the cam is switched by switching a coupling state of the plurality of rocker arms by the coupling pin, a part of an oil passage (operation passage 75) extending from the oil control valve to the switching mechanism is formed by an oil groove (26) of the camshaft, and the oil groove is formed such that the oil starts to be supplied from the oil control valve to the switching mechanism at the end timing of the valve lift or in the zero range in which no valve lift occurs. According to the configuration, since the oil groove is formed in the camshaft, the oil is intermittently supplied from the oil control valve to the switching mechanism through the oil passage as the camshaft rotates. Since the oil starts to be supplied from the oil control valve to the switching mechanism at the end timing of the valve lift or in the zero range, the coupling operation of the plurality of rocker arms is not hindered by the valve lift, and the plurality of rocker arms are appropriately coupled by the coupling pin. Therefore, the coupling state of the plurality of rocker arms is not released in the middle of the valve lift, and the generation of abnormal noise is suppressed.

In the variable valve device, another oil passage (shortcut passage 78) extends directly from the oil control valve to the switching mechanism, and after the oil is supplied to the hydraulic piston from the oil passage, the oil is supplied to the hydraulic piston from the other oil passage. According to the configuration, the hydraulic piston may move only by intermittent supply of the oil from the oil passage, but the hydraulic piston can be held by direct supply of the oil from the other oil passage.

In the variable valve device, the other oil passage is shorter than the oil passage. According to the configuration, the oil is smoothly supplied to the hydraulic piston from the other oil passage, and the hydraulic piston can be stably held.

In the variable valve device, a supply direction of the oil to the hydraulic piston from the oil passage is directed toward an advancing direction of the hydraulic piston, a supply direction of the oil to the hydraulic piston from the other oil passage is directed toward a radial direction of the hydraulic piston, and when the hydraulic piston is at a retracted position, a downstream end of the other oil passage is closed by an outer circumferential surface of the hydraulic piston, and the downstream end of the other oil passage is opened by moving the hydraulic piston in the advancing direction. According to the configuration, since the supply direction of the oil from the oil passage is directed toward the advancing direction of the hydraulic piston, the hydraulic piston can be smoothly moved in the advancing direction. In addition, since the downstream end of the other oil passage is opened and closed by the hydraulic piston, the number of components can be reduced and the variable valve device can be formed in a compact manner.

In the variable valve device, the camshaft includes a shift cam (83) on which the plurality of cams are formed, and a shaft main body (82) on which the shift cam is slidably and integrally rotatably provided, a plurality of switching grooves (88*a*, 88*b*) for sliding the shift cam with respect to the shaft main body are formed on the shift cam, and the switching mechanism is provided with a plurality of switching pins (96*a*, 96*b*) configured to enter the plurality of switching grooves by the oil pressure, the shift cam is slid to switch the cam by causing the plurality of switching pins to selectively enter the plurality of switching grooves, a part of an oil passage (91*a*, 91*b*) extending from the oil control valve to the switching mechanism is formed by an oil groove (89) of the shift cam, and the oil groove is formed such that the oil starts to be supplied from the oil control valve to the switching mechanism at the end timing of the valve lift or in the zero range in which no valve lift occurs. According to the configuration, since the oil groove is formed in the shift cam, the oil is intermittently supplied from the oil control valve to the switching mechanism through the oil passage as the shift cam rotates. Since the oil starts to be supplied from the oil control valve to the switching mechanism at the end timing of the valve lift or in the zero range, the cam is not switched in the middle of a valve lift, and thus generation of abnormal noise is suppressed.

In the variable valve device, the oil groove is formed such that a supply of the oil to the switching mechanism through the oil passage ends before the valve lift starts. According to the configuration, since the switching operation of the cam ends before the valve lift starts, the cam is not switched in the middle of the valve lift.

In the variable valve device, the oil groove is formed such that a supply of the oil to the switching mechanism through the oil passage ends after the valve lift ends and before a next valve lift starts. According to the configuration, a long supply time of the oil to the switching mechanism through the oil passage can be secured, and the switching operation of the cam performed by the switching mechanism can be stabilized.

Although the present embodiment has been described, as another embodiment, the above-described embodiment and modifications may be combined entirely or partially.

Further, the technique of the present invention is not limited to the above-described embodiments, and various changes, replacements, and modifications may be made without departing from the gist of the technical concept. Further, as long as the technical concept can be realized in another way by the progress of the technique or another derivative technique, the present invention may be implemented using the method. Therefore, the claims cover all embodiments that may fall within the scope of the technical concept.

What is claimed is:

1. A variable valve device provided in a cylinder head and capable of changing a valve lift amount, comprising:

a camshaft on which a plurality of cams with different valve lift amounts are formed;

a switching mechanism configured to switch a cam for moving a valve among the plurality of cams; and an oil control valve configured to control an oil pressure for the switching mechanism; and an oil groove is formed in a part of an outer circumferential surface of the camshaft such that oil starts to be supplied from the oil control valve to the switching mechanism at an end timing of a valve lift or in a zero range in which no valve lift occurs.

2. The variable valve device according to claim 1 further comprising:

a plurality of rocker arms configured to abut with the plurality of cams to move the valve, wherein the switching mechanism includes a coupling pin configured to couple the plurality of rocker arms and a hydraulic piston configured to move the coupling pin, the cam is switched by switching a coupling state of the plurality of rocker arms by the coupling pin, and a part of an oil passage extending from the oil control valve to the switching mechanism is formed by an oil groove of the camshaft.

3. The variable valve device according to claim 2, wherein another oil passage extends directly from the oil control valve to the switching mechanism, and after the oil is supplied to the hydraulic piston from the oil passage, the oil is supplied to the hydraulic piston from the other oil passage.

4. The variable valve device according to claim 3, wherein the other oil passage is shorter than the oil passage.

5. The variable valve device according to claim 3, wherein a supply direction of the oil to the hydraulic piston from the oil passage is directed toward an advancing direction of the hydraulic piston, a supply direction of the oil to the hydraulic piston from the other oil passage is directed toward a radial direction of the hydraulic piston, and when the hydraulic piston is at a retracted position, a downstream end of the other oil passage is closed by an outer circumferential surface of the hydraulic piston, and the downstream end of the other oil passage is opened by moving the hydraulic piston in the advancing direction.

6. The variable valve device according to claim 1, wherein the camshaft includes a shift cam on which the plurality of cams are formed, and a shaft main body on which the shift cam is slidably and integrally rotatably provided, a plurality of switching grooves for sliding the shift cam with respect to the shaft main body are formed on the shift cam, and the switching mechanism is provided with a plurality of switching pins configured to enter the plurality of switching grooves by the oil pressure, the shift cam is slid to switch the cam by causing the plurality of switching pins to selectively enter the plurality of switching grooves, and a part of an oil passage extending from the oil control valve to the switching mechanism is formed by an oil groove of the shift cam.

7. The variable valve device according to claim 2, wherein the oil groove is formed such that a supply of the oil to the switching mechanism through the oil passage ends before the valve lift starts.

8. The variable valve device according to claim 2, wherein the oil groove is formed such that a supply of the oil to the switching mechanism through the oil passage ends after the valve lift ends and before a next valve lift starts.

9. The variable valve device according to claim 1, wherein by rotation of the camshaft and the oil groove, connection and separation of the operation passages are alternately repeated.

* * * * *